United States Patent [19]

Malipier et al.

[11] 4,318,620

[45] Mar. 9, 1982

[54] APPARATUS FOR PRODUCING BITUMINOUS COATED PRODUCTS FROM AGGREGATES, BITUMEN AND SOLID MATERIALS LIKELY TO DETERIORATE AT HIGH TEMPERATURE

[75] Inventors: Louis Malipier, Saint Chamond; Guy Marconnet, St. Martin La Plaine, both of France

[73] Assignee: Creusot-Loire, Paris, France

[21] Appl. No.: 217,493

[22] Filed: Dec. 17, 1980

[30] Foreign Application Priority Data

Jan. 11, 1980 [FR] France ..... 80 00570

[51] Int. Cl.[3] ..... B28C 5/20

[52] U.S. Cl. ..... 366/25; 366/228

[58] Field of Search ..... 366/22–25, 366/144, 147, 228

[56] References Cited

U.S. PATENT DOCUMENTS 2,815,940 12/1957 Madsen ..... 366/25

4,147,436 3/1979 Garbelman ..... 366/25

4,174,181 11/1979 Garbelman ..... 366/25

*Primary Examiner*—Sam Silverberg

*Attorney, Agent, or Firm*—Pollock, Vande Sande & Priddy

[57] ABSTRACT

The apparatus is constituted by a rotatable drum (1). The solid materials and the hot gases coming from a burner (6) flow in the same direction. The drum has an introduction zone (16), a transfer zone (17), an intermediate zone (18) and a zone (19) for hot mixing of aggregates and bituminous materials. The intermediate zone (18) has a first part in which lifting paddles (28) disposed on the inner wall of the drum (1) allow a continuous curtain of materials to be formed over the whole section of the drum (1) and a second part into which the solid materials degradable at high temperature are introduced. In this second part, the drum (1) has a second inner casing (31) coaxial with its outer casing (1), equipped inside with lifting paddles (32).

The invention is particularly applicable to producing coated products for road use, from recycled materials.

4 Claims, 5 Drawing Figures

1
2
9
6
4
7
8
20
16
A
17
B
18
C
D
19
E
12
10
11
3
14
15
31
33
30
35
II
III
IV
V

APPARATUS FOR PRODUCING BITUMINOUS COATED PRODUCTS FROM AGGREGATES, BITUMEN AND SOLID MATERIALS LIKELY TO DETERIORATE AT HIGH TEMPERATURE

BACKGROUND OF THE INVENTION

The invention concerns an apparatus for producing bituminous coated products from aggregates, bitumen and solid materials which can undergo deterioration if they are exposed to a high-temperature environmemnt.

In methods of preparing hot coated bituminous products in which aggregates without bituminous material and bituminous products are introduced into a drum rotatable about its longitudinal axis, the products containing bitumen must be introduced into the drum in a zone protected from direct contact with the flame of the burner, which generally enters at the inlet end of the drum, so as to prevent degradation of these bituminous materials under the action of an atmosphere at too high a temperature.

Thus, French Pat. No. 2,327,048, filed 8th Oct., 1975, by Creusot-Loire, recommends introducing liquid bitumen for incorporation with aggregates which have been dried in the drum, in a zone of the drum protected from the flame of the burner by a continuous opaque curtain constituted by the aggregates falling over the whole section of the drum during drying.

To form this curtain of material while allowing the flame of the burner to develop up to the drying zone, a set of specially shaped lifting devices is provided on the surface of the drum in this zone, allowing the curtain of material to form progressively in the drying zone while leaving a central space free for the flame to develop.

Such an apparatus also has the advantage of preventing aggregates introduced into the drum from falling back into the flame, thereby the formation of dust from the break up of these aggregates under the action of the heat of the flame.

Such an apparatus, however, is unsuitable for solid materials containing bitumen, such as recovered bituminous products, or any other solid material subject to deterioration in a high-temperature environment, which must be introduced into the drum.

Such solid materials may be, for example, rubberized compounds, plastic materials, sulfur, coloring products such as a metal oxide or bitumen in flakes.

Even if such materials do not fall into the flame of the burner, they can be destroyed by the heat of the flame unless they are protected from its radiation in the introduction zone and the drying zone of the drum.

There are other known apparatuses for producing bituminous coated products from fresh aggregates, bitumen and a certain proportion of recycled coated products in which the recycled coated products are introduced into the drum in an intermediate zone between the inlet end through which the fresh aggregates enter and the outlet end of the drum through which the coated products are removed. Such apparatuses use the principle of forming a curtain with the fresh aggregates introduced into the drum, the recycled aggregates being introduced into a zone of the drum which is protected from the flame by this curtain of material.

The recycled materials are introduced into the drum through openings provided in the wall of the drum, and mechanical devices, such as hatches closing by gravity, prevent the material leaving the drum at this intermediate zone for introducing recycled materials.

Such apparatuses have some disadvantages, since the fresh aggregates introduced through the inlet end of the drum fall into the spatial zone in which the flame develops, and as a result cause the formation of dusts which are conveyed by the gases coming from the burner and passing through the drum. In practice, in these apparatuses, the region for drying the fresh aggregates has lifting devices which cause the fresh aggregates to fall over the whole section of the drum, especially into the flame of the burner.

This allows the intermediate zone into which the recycled materials are introduced to be protected from the flame of the burner, but interferes with the development of this flame and causes the formation of dusts which are found in the gas expelled into the atmosphere.

These apparatuses also need mechanical members such as hatches which are movable with respect to the casing of the drum at the intermediate zone for introducing recycled materials. The conditions in which the drum works makes the use of such movable closure devices undesirable.

SUMMARY OF THE INVENTION

The object of the invention is therefore an apparatus for producing from aggregates, bitumen and solid materials, bituminous coated products such as recycled coated products which can deteriorate if exposed to a high-temperature environment, comprising a drum rotatable about its axis, slightly inclined from the horizontal, in a downward direction from its inlet end to its outlet end, inside which drum flow in the same direction, the solid products and the hot gases coming from a burner entering through the inlet end of the drum through which fresh aggregates also enter, brought by a supply means into the first zone of the drum downstream of this inlet end, or introduction zone, the drum being supplied with solid materials, such as recycled coated products, at an intermediate zone disposed between the inlet end and the outlet end through which the products flowing in the drum are removed and proceeding in the direction of flow of the products, to a hot mixing zone into which the bitumen is introduced and in which the products are raised over the whole section of the drum by lifting devices and brought into contact with the hot gases passing through the drum. The apparatus is designed to prevent contact between solid materials such as the recycled coated products and an atmosphere at too high a temperature, as well as direct contact between fresh aggregates and the flame of the burner, and to allow solid materials to be introduced into the drum by means of a simple apparatus which has no component capable of moving with respect to the drum.

To accomplish this object, the drum includes, between the introduction zone and the intermediate zone, a zone for transferring fresh aggregates in which shield-paddles having a concave surface, directed towards the inner wall of the drum, are attached to this inner wall. In addition, the intermediate zone has, successively in the direction of flow of the products, a first part in which the inner wall of the drum has lifting paddles for forming a continuous curtain of solid products falling over the whole section of the drum, and a second part at which the drum, surrounded by a fixed means for introducing solid materials and presenting openings passing through its wall or first casing, has a second cylindrical casing coaxial with the first casing, smaller in diameter and equipped on its inner surface with lifting devices for forming a continuous curtain of solid products falling over the whole section of the second casing, while helical blades are disposed between the inner wall of the drum and the outer surface of the second casing so as to drive the solid materials introduced at this point in the drum towards the hot mixing region.

In order that the invention may be more clearly understood, an embodiment of an apparatus according to the invention as well as its use for producing hot coated materials from fresh aggregates, bitumen and recycled materials will now be described by way of non-limiting example.

DETAILED DESCRIPTION

Figure 1:
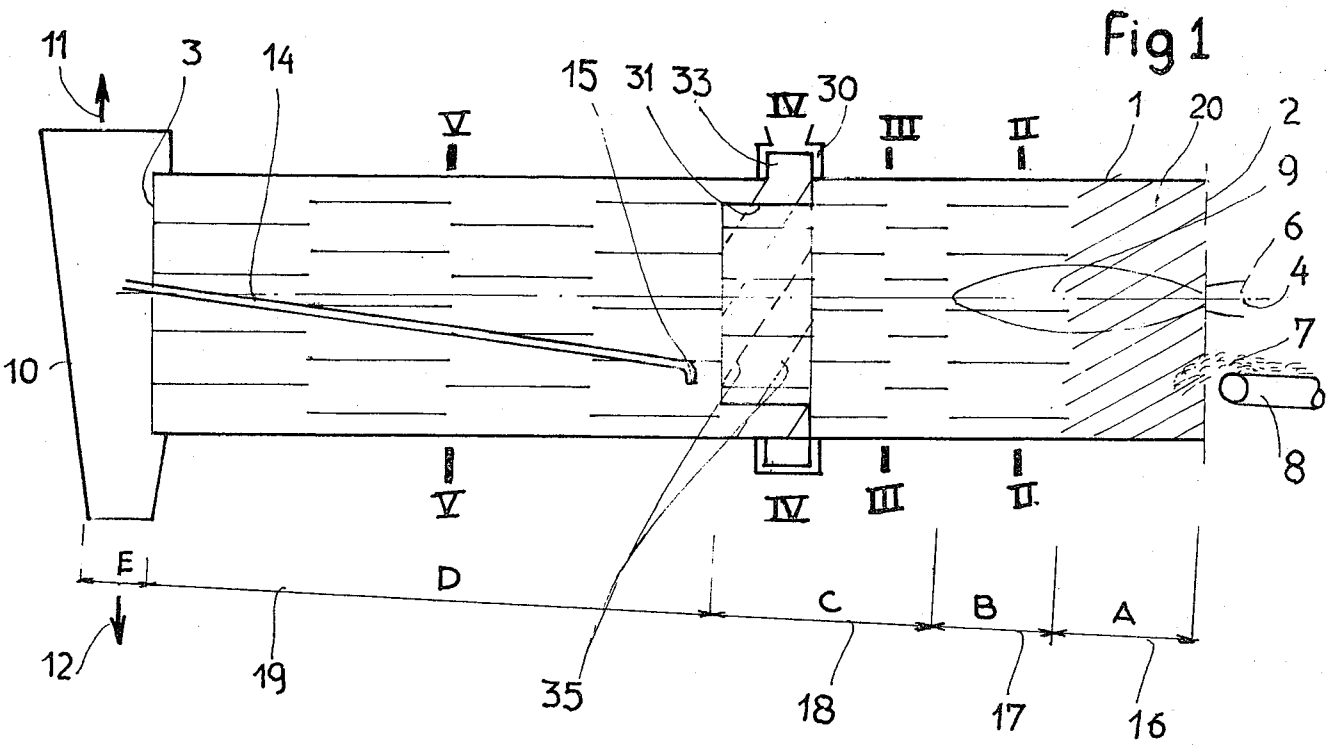
FIG. 1 is a sectional elevation through a vertical plane of symmetry of the drum and attached apparatuses associated with it.

FIG. 1 shows a drum whose outer casing 1, cylindrically shaped, has an inlet end 2 and an outlet end 3, the axis 4 of the cylinder constituting the drum being slightly inclined from the horizontal so that the inlet end of the drum is higher than the outlet end.

A burner 6, whose flame 9 is located in one part of the of the drum interior, enters at the inlet end 2 of the drum.

Fresh aggregates 7 brought to the drum by a belt conveyer of conventional type also enter at the inlet end 2 of the drum.

The outlet end 3 of the drum opens into a hopper 10 which allows the gases of the burner which have passed through the drum and particles which may be entrained to be evacuated and the coated products to pass through (arrow 12).

A conduit 14 for supplying hot molten bitumen enters into the drum through its outlet end 3 terminating in a spraying nozzle 15 which allows the bitumen to be distributed over the solid materials in the last zone of the drum.

The drum comprises in sucession from its inlet end to its outlet end, i.e., from right to left in FIG. 1, an introduction zone 16, a transfer zone 17, an intermediate zone 18 and a mixing zone 19 in which the bituminous binder is added by means of spraying nozzle 15.

The flame 9 of the burner extends into the zones 16 and 17, i.e., into the introduction zone and into the transfer zone.

Reference will be made to both FIG. 1 and FIGS. 2, 3, 4 and 5 to describe these different zones in succession.

In the zones 16, projecting blades 20 are disposed helically on the inner wall surface of the drum, so that the fresh aggregates 7 arriving through the inlet end of the drum are rapidly introduced into the transfer zone 17 after a very short transit through the zone 16 in which these materials 7 remain in contact with the wall of the drum. During this rapid transfer to a zone away from the flame, the materials are hardly dried at all and produce no dust.

Figure 2:
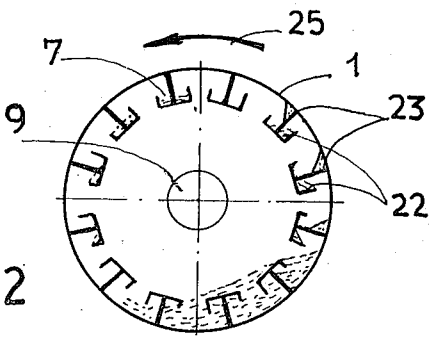

As shown in FIG. 2, the drum is equipped in the transfer zone 17 with paddles 22 held spaced from the wall of the drum by spacers 23, these paddles being shield-paddles constituted by plates folded in a U, whose hollow surface for receiving the material 7 is directed towards the wall 1 of the drum.

As shown in FIG. 2, on rotation of the drum in the direction of the arrow 25, the material 7 is held by this hollow surface directed towards the wall of the drum and drawn upwards, and then downwards inside the paddles 22 whose section is shaped as an unsymmetrical U.

Because of their flat surface directed towards the flame of the burner 9, the paddles 22 constitute shields protecting the material 7 comprising the fresh aggregates.

Thus, the fresh aggregates do not fall into the flame of the burner 9 and do not break up under the action of the heat which would otherwise produce dust particles.

Thus, the hot gases passing through the drum from the burner to the outlet end do not entrain dust in great quantities.

In this zone the aggregates contained in the shield-paddles 22 also protect the wall 1 of the drum against the heat of the flame of the burner by absorbing part of the heat of this flame.

The aggregates therefore undergo heating in this zone and begin to dry by conduction of heat through the shield-paddles.

This arrangement also improves the yield of the installation, since the heat removed through the wall 1 of the drum in this zone is considerably reduced.

Because of the angle of the drum, the fresh aggregates advance through the transfer zone until they reach the intermediate zone 18.

To aid this advance, small angle-irons (not shown) may be disposed on the inner wall of the drum.

Figure 4:
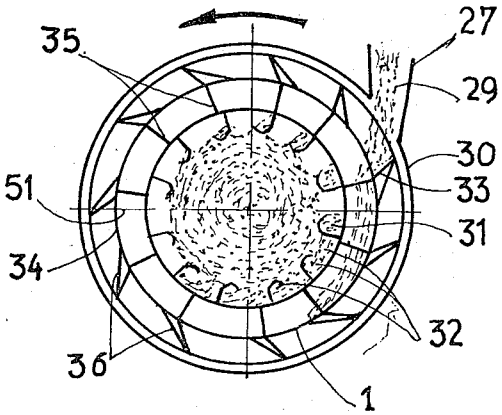
FIGS. 2, 3, 4 and 5 are transverse sections of the drum at sections 2—2, 3—3, 4—4 and 5—5 of FIG. 1.
Figure 3:
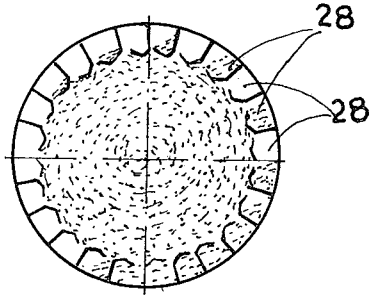

As shown in FIGS. 3 and 4, the intermediate zone has two distinct parts, the first part, whose section is represented in FIG. 3, being a zone where a continuous curtain of material is formed and the second part, represented in FIG. 4, a zone for introducing solid materials which cannot withstand excessive temperatures.

In the first part of the intermediate zone, the drum has on its inner surface several sets of lifting paddles 28 angularly staggered lengthwise along the drum for forming a dense continuous opaque curtain of aggregates 7 over the whole transverse section of the drum. These lifting paddles are shaped to present a concavity towards the inner surface of the drum and are constituted by folded plates.

As shown in FIG. 4, the drum is surrounded at the second part of the intermediate zone by a fixed structure for introducing recycled materials 29, comprising an introduction hopper 27 and a closed cylindrical body 30 surrounding the drum with a slight clearance allowing the latter to rotate.

Also in this intermediate zone, the drum, in addition to its outer 1, has an inner casing or second casing 31 coaxial with the first which extends over the whole second part of the intermediate zone up to the inlet of the mixing zone 19.

On its inner wall, this inner shell 31 bears sets of paddles 32 comparable to the paddles 28 of the first part of the intermediate zone.

On the outer wall 1 of the drum, on the fixed casing 30 of the apparatus for introducing recycled coated products, chutes 36 are fixed, projecting outwards and allowing materials entering through the hopper 27 to be introduced into the space between inner casing 31 and the outer casing of the drum 1, equipped with helical blades 35. The chutes 36 have inclined guiding surfaces 33 for introducing materials through the openings 34 in the drum 1.

The helical blades 35 are disposed between the outer or first casing of the drum and the shell 31 constituting the second casing so that when the drum and the shell 31 which is solid with the outer casing of the drum are rotated, the helical blades 35 drive the recycled products 29 towards the hot mixing zone 19 in which these recycled materials mix with the fresh aggregates 7 arriving via the inner part of the shell 31.

In the intermediate zone 18, the fresh aggregates are intensively and completely dried, since they are exposed over the whole section of the drum to hot gases coming from the burner at the first part and the second part of this intermediate zone.

The aggregates 7 which enter the hot mixing zone are consequently perfectly dry.

In addition, the curtain of materials formed over the whole length of the intermediate zone, first at the first part of this zone over the whole section of the drum and then inside the shell 31, smaller in diameter than the diameter of the drum, completely insulates the hot mixing zone from the flame of the burner, and therefore completely protects the recycled materials arriving at the end of the shell 31, and also the liquid bitumen distributed by the spraying nozzle 15 over the mixture of recycled materials and fresh aggregates.

Figure 5:
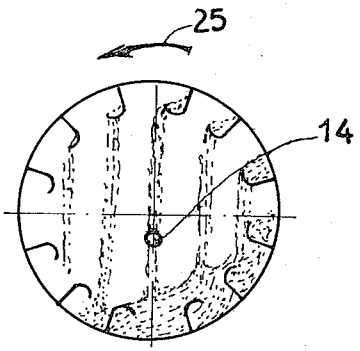

As FIG. 5 shows, at the hot mixing zone, the inner wall of the drum has lifting paddles with a degree of concavity which allow the materials to be raised and these materials to be dropped over the whole section of the drum in which these materials are exposed to gases circulating in the drum at the zone 19.

These gases are still hot but have already cooled considerably in relation to the preceding zones, since they have already dried the fresh aggregates in the intermediate zone. These gases are therefore capable of aiding the coating of the aggregates while simultaneously as avoiding destruction of the bitumen of the recycled materials and the bitumen introduced as liquid by the pipe 14 and the spraying nozzle 15.

Hot mixing occurs in the zone 19, so that the mixture of fresh aggregates, liquid bitumen and recycled aggregates, combined with the action of the hot gases circulating in the drum at this point, produces coated materials equivalent in quality to materials produced solely by the mixing of dried fresh aggregates and bitumen, the bitumen of the recycled aggregates being re-melted under the action of the heat.

The materials passing out through the face 3 of the drum and into the hopper 10 are therefore constituted by coated products which are entirely comparable to coated products obtained by methods which do not make use of recycled materials.

It is clear that the principal advantages of the apparatus according to the invention are on the one hand, the prevention of fresh aggregates falling into the flame of the burner by means of shield-paddles which also isolate the drum wall with these aggregates, and, on the other hand, the complete insulation of the zone into which the recycled materials and the liquid bitumen are introduced from the zone where the flame is located, which is confined behind a very dense curtain of material. A further advantags is the fact that the apparatus for introducing recycled materials into the drum has no component which is movable with respect to the drum.

In addition, as in previous apparatuses in which the flame and hot gases are confined behind a curtain of extremely dense material, the gases dry the aggregate very intensively and very effectively before introduction of the liquid bitumen and mixing with recycled materials.

The invention is not limited to the embodiment just described; it also includes all the variants thereof and modifications in points of detail.

Thus, in particular, the shape of the blading described is far from being the only one possible, and lifting paddles with a sharp-edged or a curved shape with a larger or smaller radius of curvature can just as well be used.

The shield-paddles of the transfer zone of the drum can have a sharp-edged shape and be made of folded plates with a section comparable to that represented in FIG. 2, or alternatively can be constituted by a plate bent to a curved surface. In all instances, the hollow surface or the concavity of the curved surface is directed towards the inner wall of the drum.

In the example described, the apparatus is used to produce coated products from fresh materials and a certain proportion of recycled material. But it is also possible to use the apparatus according to the invention to produce coated materials from fresh materials and a certain amount of additional elements which cannot stand exposure to excessive heat, such as rubberized compounds, plastic materials, sulfur, coloring products such as iron oxide or bitumen in flakes.

The invention is particularly but not exclusively applicable to the production of bituminous coated products for road surfacings.

We claim:

1. In apparatus for producing bituminous coated products from aggregates, bitumen and solid materials subject to deterioration or exposure to a high-temperature environment, comprising a drum rotatable about its axis, slightly inclined from the horizontal in a downward direction from its inlet end to its outlet end, inside which drum flow, in the same direction, solid products and hot gases entering from a burner by way of said inlet end of said drum through which fresh aggregates also enter, brought by a supply means into a first zone of said drum downstream of said inlet end, said drum being applied with solid materials such as recycled coated products at an intermediate zone disposed between said inlet end and said outlet end through which the products flowing in the drum are removed, and proceeding, in the direction of flow of said products, to a hot mixing zone into which said bitumen is introduced and in which said products are raised over the whole section of the drum by lifting devices and brought into contact with the hot gases passing through said drum, the improvement comprising (a) a zone for the transfer of fresh aggregates located between said first zone and said intermediate zone of said drum, said transfer zone comprising a plurality of shield-paddles attached to said inner wall of said drum and each having a hollow surface directed towards said inner wall;

(b) said intermediate zone comprising, in the direction of flow of said products, (i) a first part in which the inner wall of said drum has lifting paddles thereon for forming a continuous curtain of solid products falling over the whole section of said drum; and (ii) a second part at which said drum, surrounded by a fixed means for introducing solid materials and having openings passing through its outer casing, has an inner casing coaxial with said outer casing, smaller in diameter and equipped on its inner surface with lifting means for forming a continuous curtain of solid products falling over the whole section of said inner casing, helical blades being disposed between the inner wall of said drum and the outer wall of said second casing to drive the solid materials introduced at this point in said drum towards said hot mixing zone.

2. Apparatus for producing coated products according to claim 1, wherein said shield-paddles comprise plates having a length substantially equal to the length of said transfer zone and bent so as to present a hollow surface towards the inner wall of said drum and a protective surface serving as a shield towards the inner part of said drum in which the flame develops.

3. Apparatus for producing coated products according to claim 1 or 2, comprising chutes attached to the exterior of said drum between the openings provided in the side surface of said drum, said chutes constituting inclined surfaces for guiding solid materials towards said openings.

4. Apparatus for producing coated products according to claim 1 or 2, comprising conduit means for introducing bitumen through the outlet end of the drum, said conduit means terminating in a spraying nozzle disposed in a zone near the inlet of the hot mixing zone.

* * * * *